US012037874B1

(12) United States Patent
Mohamed et al.

(10) Patent No.: US 12,037,874 B1
(45) Date of Patent: Jul. 16, 2024

(54) SLEEVE FOR MULTI-STAGE WELLBORE STIMULATION

(71) Applicant: Halliburton Energy Services, Inc., Houston, TX (US)

(72) Inventors: Ahmed Mohamed, Al Khobar (SA); Ibrahim El Mallawany, Al-Khobar (SA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/323,609

(22) Filed: May 25, 2023

(51) Int. Cl.
*E21B 34/14* (2006.01)
*E21B 43/16* (2006.01)
*E21B 43/25* (2006.01)

(52) U.S. Cl.
CPC ..... *E21B 34/14* (2013.01); *E21B 43/16* (2013.01); *E21B 43/25* (2013.01)

(58) Field of Classification Search
None
See application file for complete search history.

(56) References Cited

U.S. PATENT DOCUMENTS

| | | | | |
|---|---|---|---|---|
| 7,703,510 | B2 | 4/2010 | Xu | |
| 8,499,841 | B2 | 8/2013 | Tinker et al. | |
| 9,394,777 | B2 | 7/2016 | Cheng et al. | |
| 9,574,421 | B1 * | 2/2017 | Saraya | E21B 34/142 |
| 9,951,596 | B2 | 4/2018 | Lynk | |
| 10,669,830 | B2 | 6/2020 | Facca et al. | |
| 10,994,493 | B2 * | 5/2021 | Linde | B29C 66/8362 |
| 10,995,593 | B2 * | 5/2021 | Saraya | E21B 34/142 |
| 2003/0221837 | A1 * | 12/2003 | Giroux | E21B 34/063 166/321 |
| 2009/0266659 | A1 | 10/2009 | Lembcke et al. | |
| 2011/0278017 | A1 | 11/2011 | Themig et al. | |
| 2013/0284451 | A1 * | 10/2013 | Merron | E21B 34/103 166/330 |

(Continued)

FOREIGN PATENT DOCUMENTS

| | | |
|---|---|---|
| WO | 2016112612 | 7/2016 |
| WO | 2020018755 | 1/2020 |

OTHER PUBLICATIONS

"PCT Application No. PCT/US2023/067581, International Search Report and Written Opinion", Feb. 20, 2024, 11 pages.

*Primary Examiner* — Matthew Troutman
*Assistant Examiner* — Douglas S Wood
(74) *Attorney, Agent, or Firm* — DeLizio, Peacock, Lewin & Guerra, LLP

(57) ABSTRACT

An assembly comprises a tubular housing having a bore therethrough and at least one stimulation port therein to communicate fluid from the bore to outside the tubular housing and a sleeve axially movable in the tubular housing. The sleeve comprises a first baffle and a second baffle. The sleeve is initially in a first closed position, wherein the sleeve is to axially move from the first closed position to an open position in response to the first baffle receiving a first object therein, wherein the at least one stimulation port is open in the open position. The sleeve is to axially move from the open position to a second closed position in response to the second baffle receiving a second object received therein, wherein the second object is larger than the first object, where the at least one stimulation port is closed in the second closed position.

24 Claims, 12 Drawing Sheets

(56) References Cited

U.S. PATENT DOCUMENTS

| | | | | |
|---|---|---|---|---|
| 2014/0034319 | A1* | 2/2014 | Surjaatmadja | E21B 43/26 166/305.1 |
| 2014/0158357 | A1 | 6/2014 | Lyashkov et al. | |
| 2014/0246209 | A1* | 9/2014 | Themig | E21B 34/142 166/194 |
| 2015/0260012 | A1* | 9/2015 | Themig | E21B 34/142 166/317 |
| 2016/0160603 | A1* | 6/2016 | Sevadjian | E21B 33/14 166/288 |
| 2018/0347330 | A1* | 12/2018 | Facca | E21B 34/14 |
| 2020/0024936 | A1* | 1/2020 | Chang | E21B 43/26 |
| 2021/0079759 | A1 | 3/2021 | Benson | |

* cited by examiner

SLEEVE FOR MULTI-STAGE WELLBORE STIMULATION

BACKGROUND

As part of hydrocarbon recovery from subsurface formations into which a wellbore is formed, different zones of the subsurface formations may be stimulated in order to assist and maximize recovery of hydrocarbons. For example, stimulation may enable extraction of hydrocarbons that may be trapped in unconventional formations.

BRIEF DESCRIPTION OF THE DRAWINGS

Embodiments of the disclosure may be better understood by referencing the accompanying drawings.

DESCRIPTION

Figure 1:
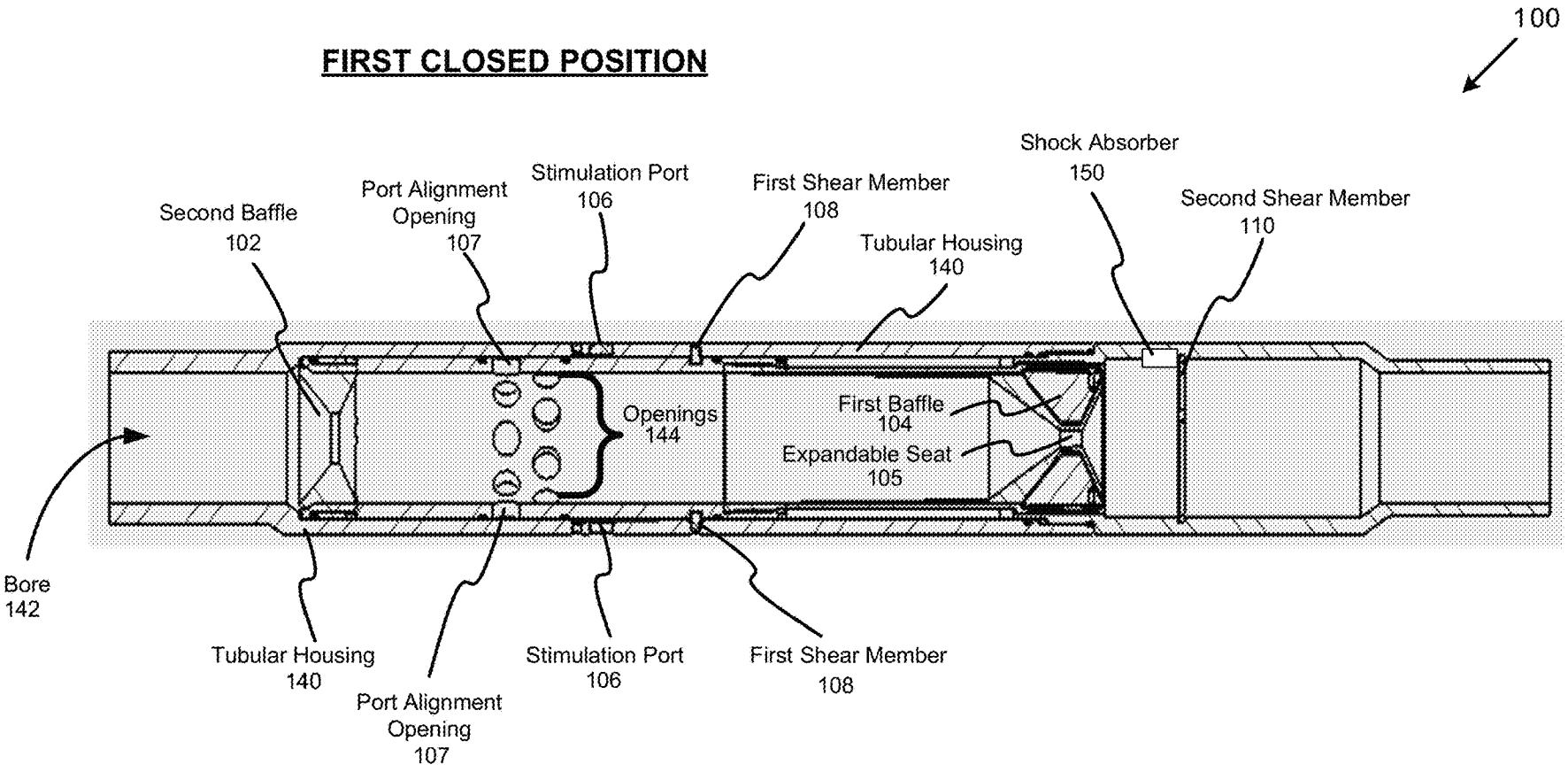
FIG. 1 is a cross-sectional view of a sleeve in a first closed positioned and to be positioned downhole in a wellbore, according to some embodiments.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Example embodiments may include a sleeve to be positioned in a wellbore and to be used for stimulation operations. For example, some implementations may be used for fracking operations of the surrounding subsurface formation. Some implementations may include a single sleeve having at least three positions and at least two baffles. A first position may be a first closed position. For example, the sleeve may be in the first closed position when running the sleeve downhole into position. In response to dropping a first object downhole into the sleeve, the sleeve may then be moved to a second position—an open position to allow for stimulation via stimulation ports. For example, the sleeve may be moved into the open position in response to the first object being dropped into a first baffle of the sleeve (after passing through a second baffle). In some implementations, the first baffle may be a multi-entry (ME) baffle that includes an expandable seat. The second baffle may be a single entry (SE) baffle that includes a solid (non-expandable) seat.

The sleeve may have at least two shear members. A first shear member may be sheared in response to a pressure increase in the sleeve caused by the first object being in the seat of the first baffle. This shearing of the first shear member may result in the sleeve moving downward to the open position. In response to the shearing of the first shear member, the first baffle may also extrude outwards to allow the first object to pass. However, the sleeve will be stopped from further downwards by a second shear member. Thus, the sleeve is in an open position to allow this zone of the subsurface formation to be fracked. In response to the pressure increase caused by the first object being in the first baffle, the sleeve may move downward (because of the shearing of the first shear member). In turn, this may cause the inner diameter of the first baffle to expand outwards. This increase in the inner diameter of the first baffle enables the first object to travel further downward and to be seated in the second baffle of a different sleeve positioned below this current sleeve in the wellbore. This may result in closing the stimulation ports of this different sleeve below.

After stimulation (e.g., fracking) is complete for the zone of the subsurface formation where this sleeve is positioned, a second object (larger than the first object) is dropped into the sleeve. This second object may open the first baffle of the sleeve above this current sleeve—landing in the second baffle of the current sleeve. In response to dropping the second object into the sleeve, the sleeve may then be moved to a third position—a second closed position to close the stimulation port. For example, the sleeve may be moved into the second closed position in response to the second object being dropped into a seat of a second baffle of the sleeve. The sleeve may have a second shear member that is sheared in response to a pressure increase in the sleeve caused by the second object being in the seat of the second baffle. This shearing of the second shear member may result in the sleeve moving downward to the second closed position.

Some implementations may include erodible nozzles. These erodible nozzles may initially choke or block the flow through the stimulation ports in order to allow sufficient flow of the fluid downhole to ensure that the first object lands in a different sleeve below in order to close this different sleeve. For example, the erodible nozzles may be composed of material that when exposed to the stimulation fluid breaks down or dissolves over time. Then, after the erodible nozzles in the current sleeve erode, fracking of the current subsurface formation may occur through stimulation ports of the current sleeve. This process may be repeated on multiple zones having sleeves with baffles with incrementally larger inner diameters and dropping incrementally larger objects.

Some implementations may include a damping fluid to dampen movement resulting from shearing the first shear member so that the sleeve lands relatively gently on the second shear member and does not damage or prematurely shear the second shear member from impact from movement of the sleeve.

Accordingly (as further described below), example embodiments may include a single sleeve—not requiring multiple sleeves (e.g., one sleeve for closing and one sleeve for opening). Also, example embodiments may enable fracking then closing the frac sleeves after fracturing is complete without running intervention tools on wireline, slickline, coil tubing, etc. to close the sleeve. Additionally, such embodiments would minimize the risk of the sleeve getting stuck in the wellbore during such trips in and out of the wellbore for opening and closing of the sleeve. Also, closing force obtained by dropping objects into the sleeves is much greater than the force obtained by a shifting tool run on coil tubing.

In some implementations, the sleeve may be configured to be run downhole as a single sleeve. The single sleeve may then be split in two when the first object is dropped. For example, the first shear member may be configured to be weaker than the second shear member. In response to the first object being dropped, a bottom half of the sleeve may move downward to expose the stimulation ports (to enable stimulation of the subsurface formation). The first object may continue downhole to close the sleeve below. After stimulation is complete, the second object may be dropped on the second baffle which opens the sleeve above and closes the current sleeve.

In some implementations, a wellbore system may include multiple sleeves positioned at different depths along the wellbore formed in a subsurface formation. Each sleeve may be associated with a different zone of the subsurface formation, such that a given zone may be stimulated with fluid using stimulation ports of the sleeve. For example, a given zone may be stimulated as part of fracking operations. One zone at a time may be stimulated. In some implementations, the zone that is deepest in the wellbore is stimulated first, followed by the zone above, etc. until the zone nearest the surface of the wellbore is stimulated.

Example Sleeves

Different example implementations of a sleeve are now described with reference to FIGS. 1-10. FIG. 1 is a cross-sectional view of a sleeve in a first closed positioned and to be positioned downhole in a wellbore, according to some embodiments.

Figure 12:
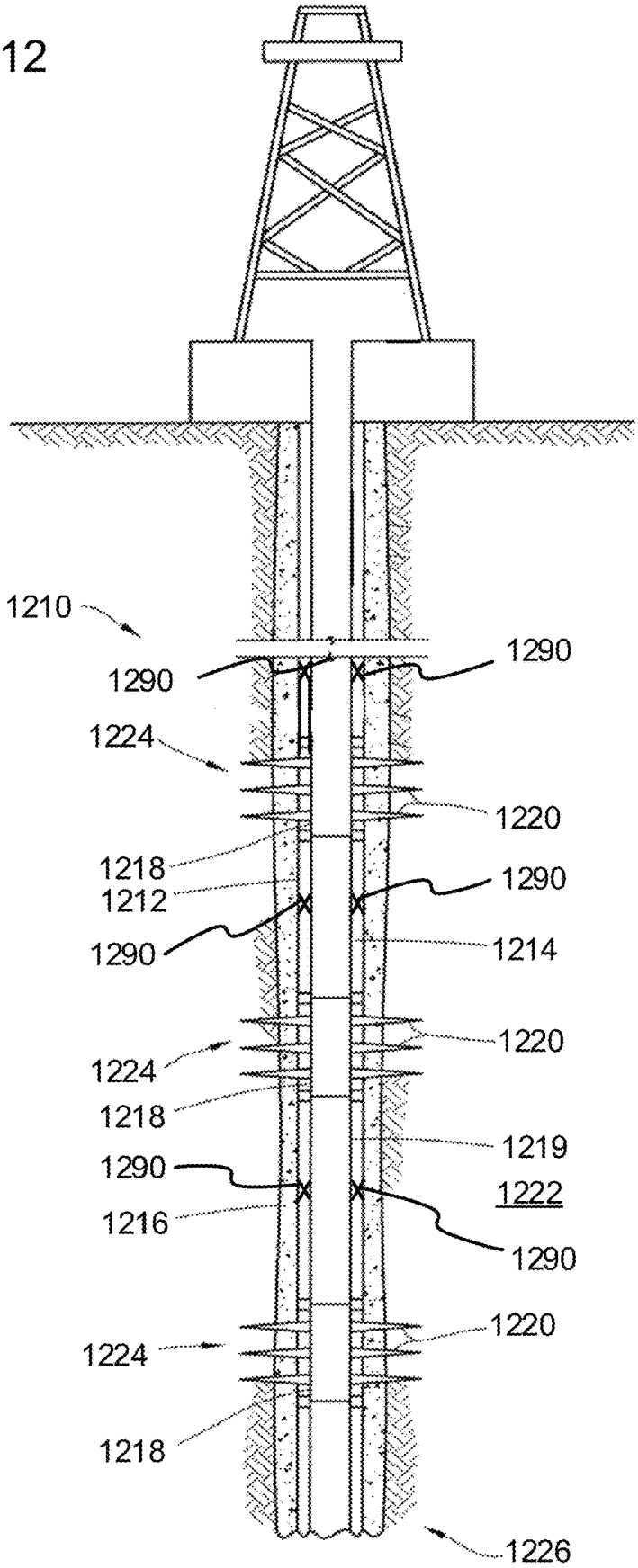
FIG. 12 is an elevation view in partial cross section of a well system having sleeves for multi-stage stimulation, according to some embodiments.

A sleeve 100 (shown in FIG. 1) is in a first closed position—which may be the position of the sleeve 100 while the sleeve 100 is run downhole into position in a casing lining a wellbore or an open hole section. An example of such a wellbore system is depicted in FIG. 12 (which is further described below). In FIG. 1, assume a surface and bottom on the wellbore are on the left side and right side, respectively. The sleeve 100 may include a tubular housing 140 having a bore 142 formed therethrough. The sleeve 100 also includes a number of openings 144, a stimulation port 106, and a port alignment opening 107.

The sleeve 100 also includes a first baffle 104 and a second baffle 102. The first baffle 104 includes an expandable seat 105. In this example, the second baffle 102 is positioned closer to a surface of the wellbore (as compared to the first baffle 104). In some implementations, the first baffle 104 may be a multi-entry (ME) baffle that includes an expandable seat. The second baffle 102 may be a single entry (SE) baffle that includes a solid (non-expandable) seat. The sleeve 100 also includes a first shear member 108 and a second shear member 110. The sleeve 100 may be held in position by the first shear member 108.

In some implementations, the sleeve 100 also includes a shock absorber 150 positioned above the second shear member 110. As further described below, the shock absorber 150 may reduce the impact on the second shear member 110 to avoid the second shear member 110 being prematurely sheared and help the second shear member 110 to stop the sleeve 100 in the open position after the sleeve 100 moves downward after the first shear member 108 is sheared.

Figure 2:
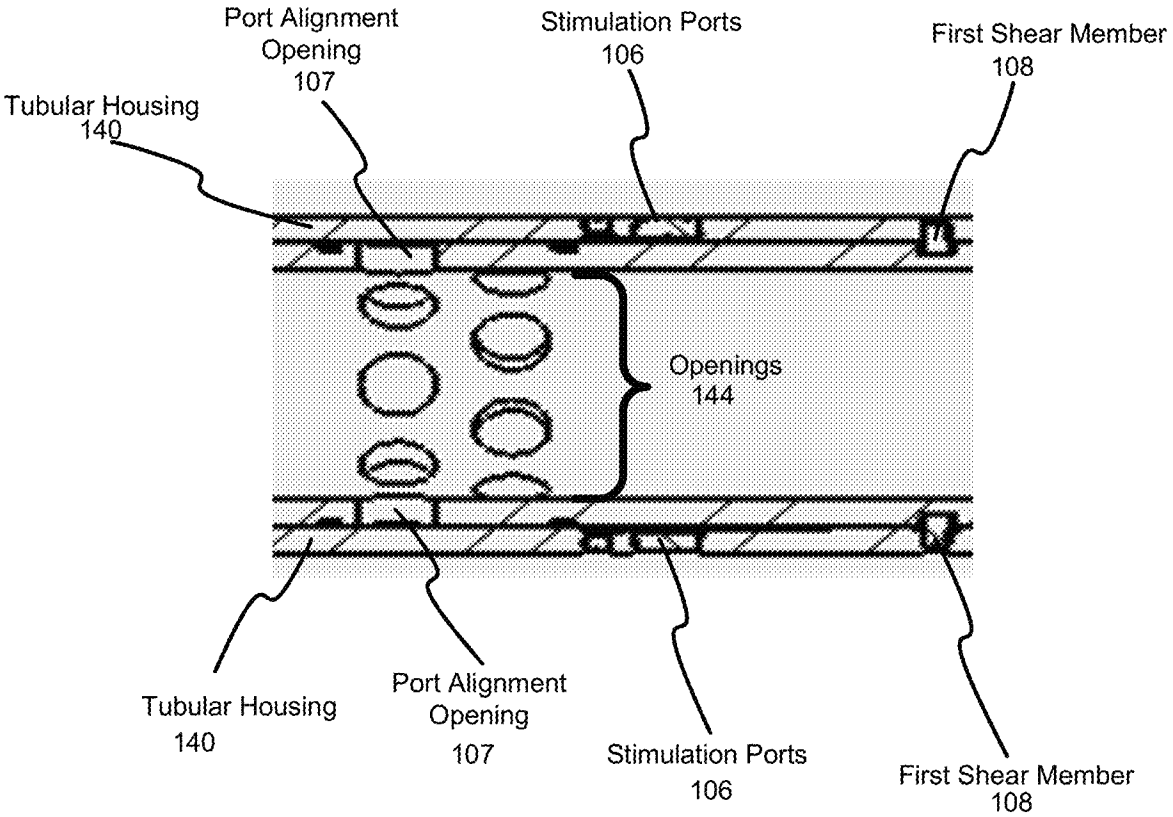
FIG. 2 is a more detailed cross-sectional view of a portion of the sleeve of FIG. 1, according to some embodiments.

FIG. 2 is a more detailed cross-sectional view of a portion of the sleeve of FIG. 1, according to some embodiments. FIG. 2 depicts a more detailed view of a portion of the tubular housing 140, the port alignment opening 107, the stimulation port 106, and the first shear member 108.

The sleeve 100 may first be run downhole while in a first closed position. Additionally, the sleeve 100 is held in position (not allowing the sleeve to move to a lower position) by the first shear member 108. While in a closed position, the stimulation ports 106 are not aligned with the port alignment opening 107 so that the stimulation ports 106 are closed. Accordingly, in the closed position, stimulation fluid flowing downhole through the bore 142 does not flow out from the stimulation ports 106 and into the surrounding subsurface formation.

Figure 3:
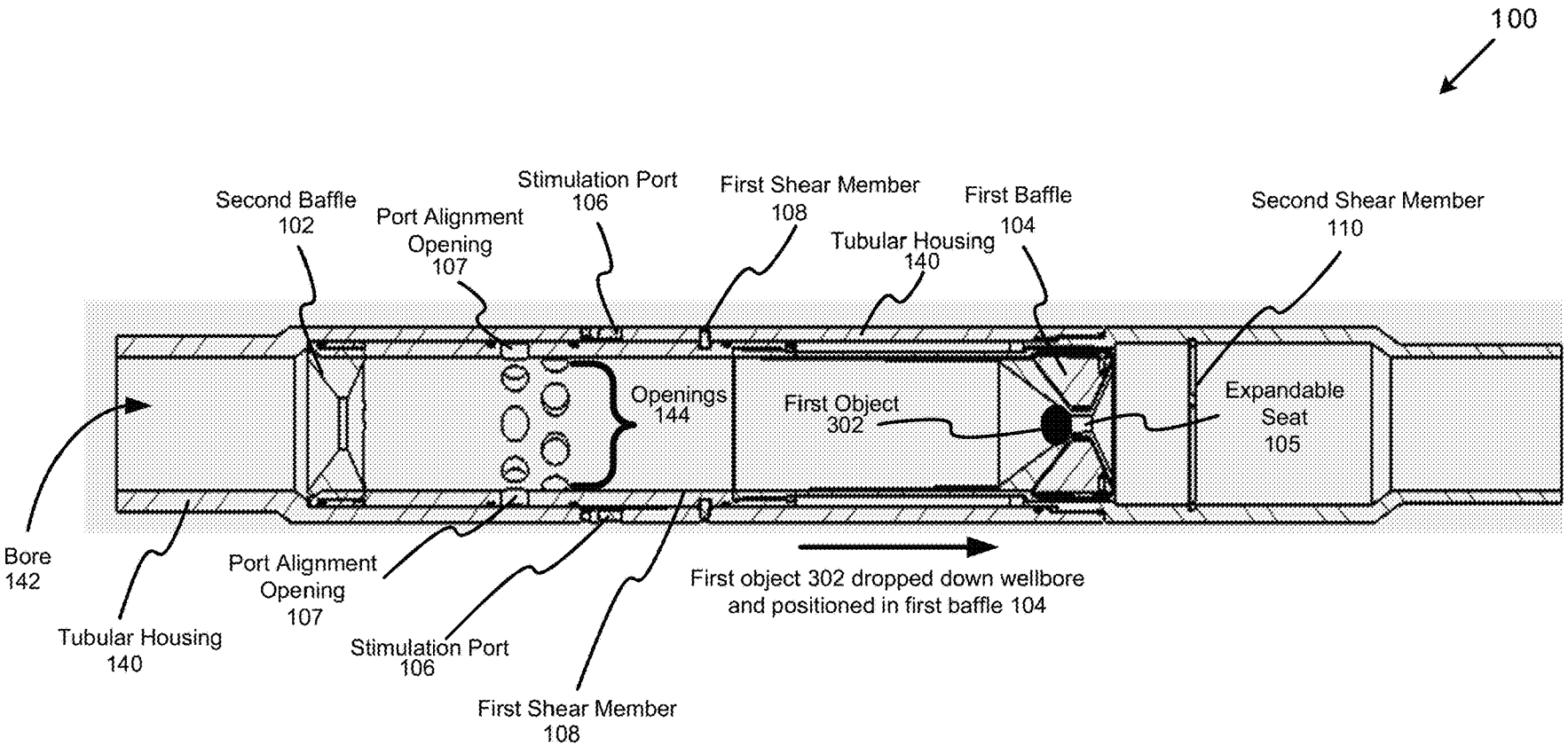
FIG. 3 is a cross-sectional view of the sleeve of FIG. 1 after a first object is dropped down the wellbore and passed through a second baffle and to a seat of a first baffle in the sleeve, according to some embodiments.

Next, the sleeve 100 is moved from the first closed position to an open position. To illustrate, FIG. 3 is a cross-sectional view of the sleeve of FIG. 1 after a first object is dropped down the wellbore and passed through a second baffle and to a seat of a first baffle in the sleeve, according to some embodiments. To move the sleeve 100 from a first closed position to an open position, a first object 302 is pumped downhole via fluids flowing through the bore 142. A diameter of a first object 302 may be smaller than an inner diameter of the second baffle 102 so that the first object 302 passes through the second baffle. The diameter of the first object 302 may be larger than an inner diameter of the first baffle 104. Accordingly, the first object 302 lands in the expandable seat 105 of the first baffle 104. While depicted as having an oval or circular shape, the first object 302 may be any other shape (such as triangular, square, etc.).

Figure 4:
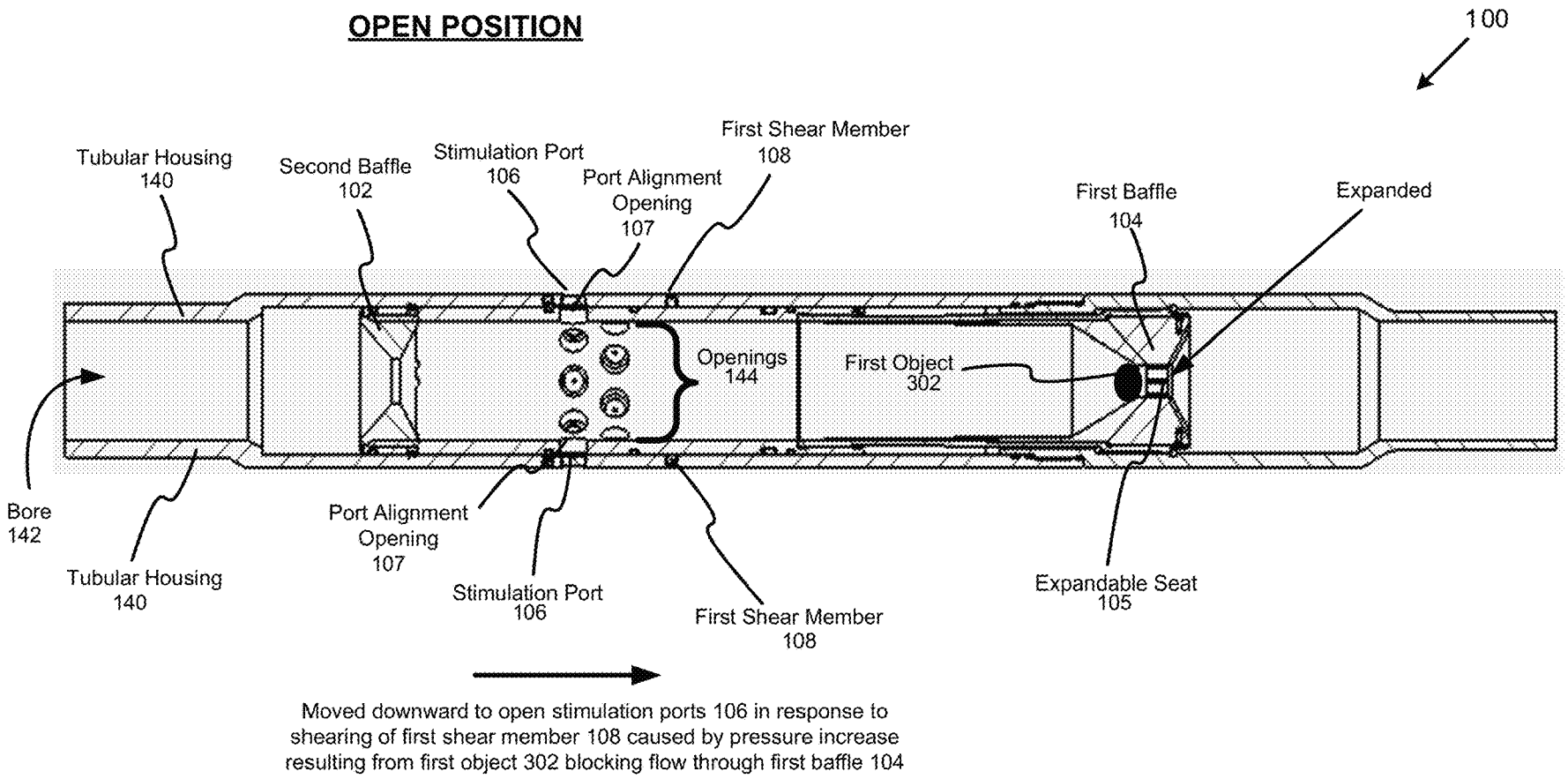
FIG. 4 is a cross-sectional view of the sleeve of FIG. 3 after the sleeve moves downward to an open position in response to shearing of a first shear member due to a pressure increase, according to some embodiments.

FIG. 4 is a cross-sectional view of the sleeve of FIG. 3 after the sleeve moves downward to an open position in response to shearing of a first shear member due to a pressure increase, according to some embodiments. The sleeve 100 moves downward and is stopped by the second shear member 110. Thus, the second shear member 110 stops the sleeve 100 in the open position by aligning the port alignment opening 107 with the stimulation port 106.

The stimulation fluid may continue to flow through the bore 142 from the surface of the wellbore. Because the first object 302 is seated in the expandable seat 105 of the first baffle 104, flow of the stimulation fluid is blocked from flowing further downhole in the wellbore beyond the first baffle 104. This will result in an increasing pressure on the first object 302. This pressure on the first object 302 continues to increase until the first shear member 108 is sheared forcing the sleeve 100 to move downward to an open position. In particular, as shown in FIG. 4, the sleeve 100 has moved downward such that the port alignment opening 107 is aligned with the stimulation port 106. Accordingly, the stimulation fluid flowing in the bore 142 is output through the stimulation port 106 via the openings 144 into the surrounding subsurface formation. Additionally, as shown in FIG. 4, as the first baffle 104 moves downward, the expandable seat 105 moves further downward to a position that enables the expandable seat 105 to expand.

Figure 5:
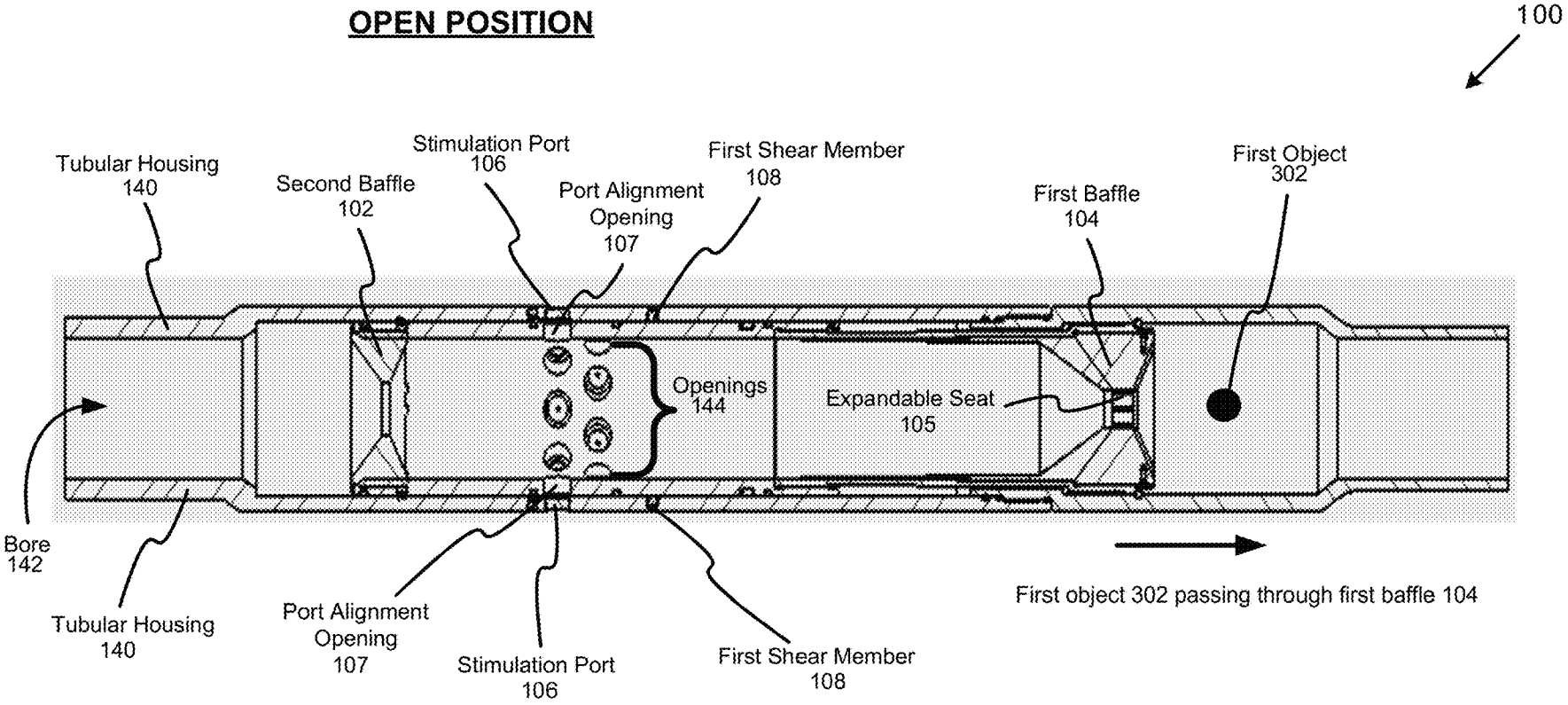
FIG. 5 is a cross-sectional view of the sleeve of FIG. 4 after the first object passed through the first baffle in response to the sleeve moving downward that results in an inner diameter increase of the first baffle, according to some embodiments.

FIG. 5 is a cross-sectional view of the sleeve of FIG. 4 after the first object passed through the first baffle in response to the sleeve moving downward that results in an inner diameter increase of the first baffle, according to some embodiments. As shown in FIG. 5, the sleeve 100 is still in the open position. As the sleeve 100 moves downward, the first baffle 104 enters an area with a larger inner diameter—thereby allowing the expandable seat 105 to further expand outward. This expansion of the expandable seat 105 allows the first object 302 to pass through the first baffle 104. In some implementations, the first object 302 may pass through a bore of a sleeve positioned below the sleeve 100—landing on the second baffle of this sleeve below to close this sleeve.

Figure 6:
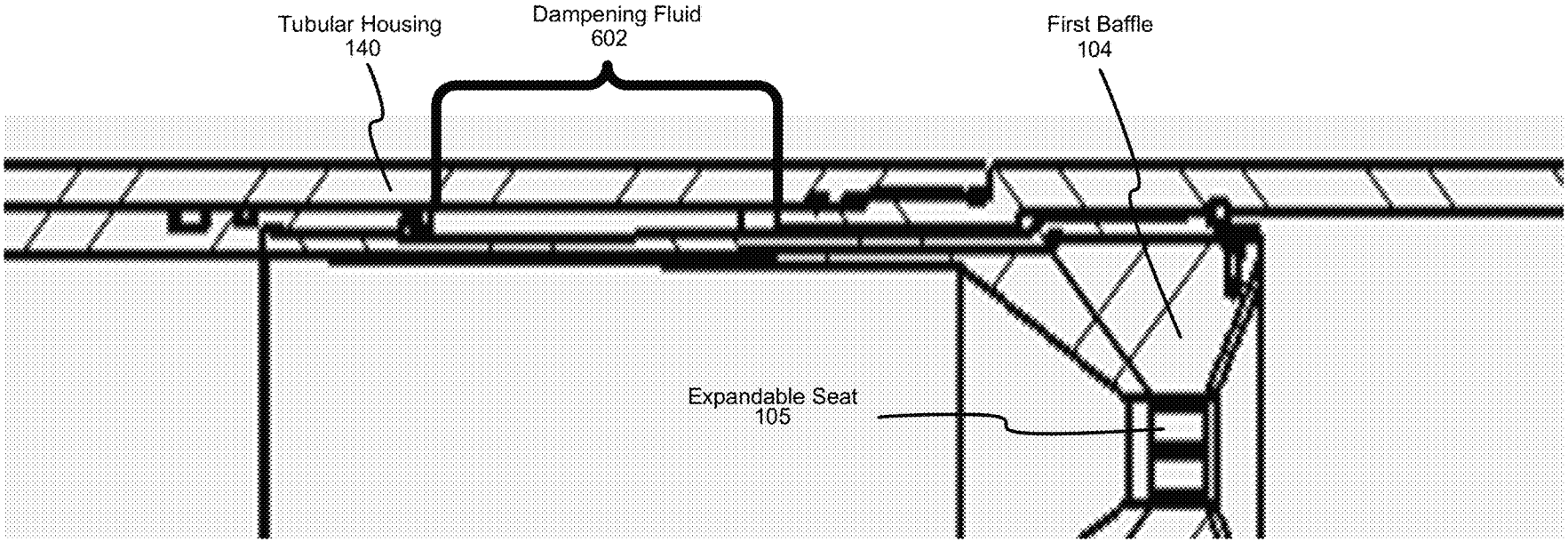
FIG. 6 is a more detailed cross-sectional view of a portion of the sleeve of FIG. 1 that includes a dampening fluid, according to some embodiments.

In some implementations, the stimulation port 106 may include an erodible nozzle. The erodible nozzle may initially choke or block the flow through the stimulation port 106 in order to allow sufficient flow of the fluid downhole to ensure that the first object 302 lands in a different sleeve below this current sleeve in order to close this different sleeve. For example, the erodible nozzle may be composed of material that when exposed to the stimulation fluid breaks down or dissolves over time, or eroded by the flow through it. Then, after the erodible nozzle in the current sleeve erodes, stimulation (e.g., fracking) of the current subsurface formation may occur through the stimulation port 106 of the current sleeve. t FIG. 6 is a more detailed cross-sectional view of a portion of the sleeve of FIG. 1 that includes a dampening fluid, according to some embodiments. FIG. 6 depicts a more detailed view of a portion of the tubular housing 140, the first baffle 104, and the expandable seat 105. The tubular housing 140 may include a dampening fluid 602 positioned above the second shear member 110 to dampen movement of the sleeve 100 that is a result of shearing the first shear member 108. The dampening fluid 602 may reduce the impact of the sleeve 100 on the second shear member 110 as the sleeve 100 moves downward—landing on the second shear member 110. This dampening fluid 602 may prevent the premature shearing of the second shear member 110 that may be caused by impact of the sleeve 100 as it moves to the open position.

Figure 7:
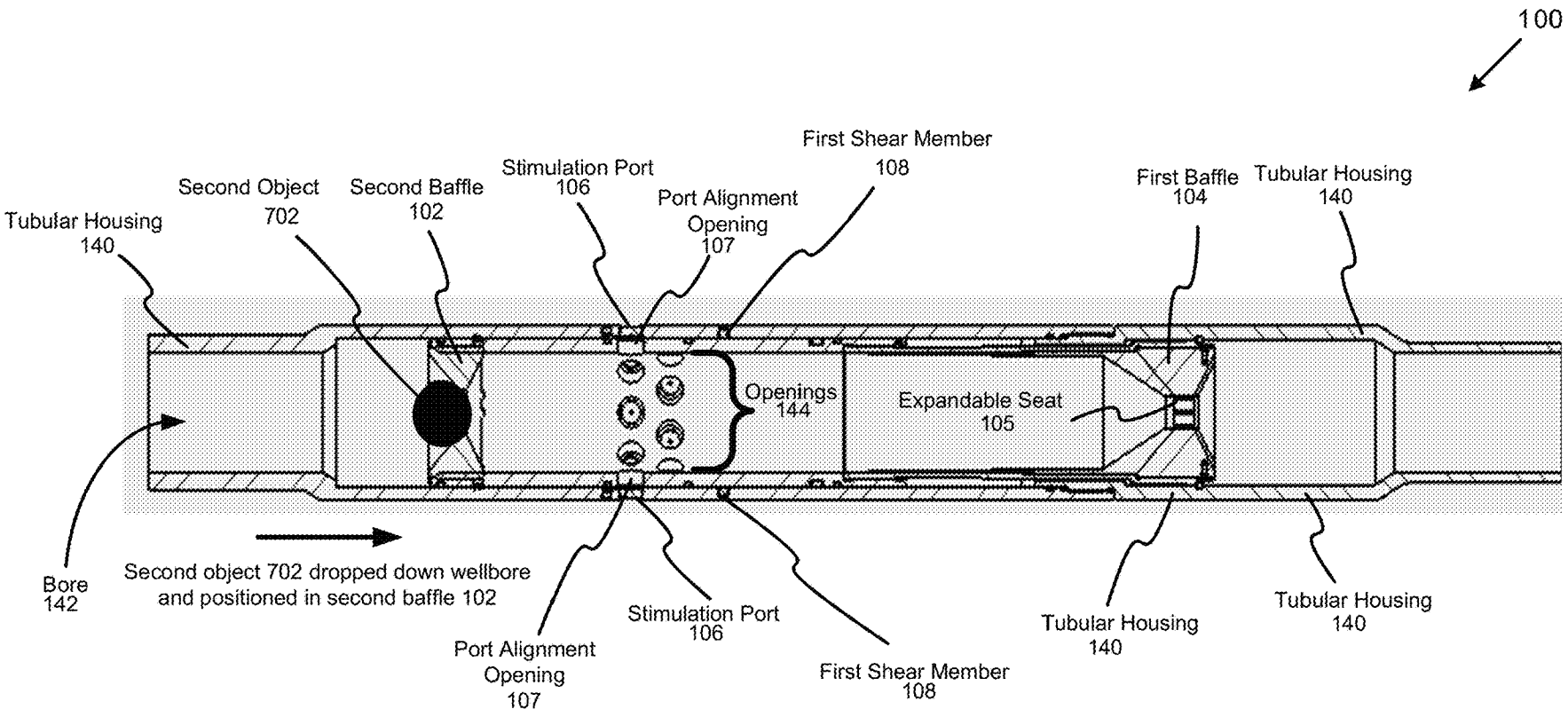
FIG. 7 is a cross-sectional view of the sleeve of FIG. 5 after a second object is dropped down the wellbore to a seat of a second baffle in the sleeve, according to some embodiments.

FIG. 7 is a cross-sectional view of the sleeve of FIG. 5 after a second object is dropped down the wellbore to a seat of a second baffle in the sleeve, according to some embodiments. After stimulation operations of the zone in the surrounding subsurface formation is complete, a second object 702 may be pumped downhole through the bore 142. The second object 702 may be larger than an inner diameter of the second baffle 102. Accordingly, the second object 702 may be seated in the second baffle 102. In some implementations, the second object 702 may be the first object being released by the first baffle from the sleeve above the sleeve 100 in the wellbore. While depicted as having an oval or circular shape, the second object 702 may be any other shape (such as triangular, square, etc.).

Figure 8:
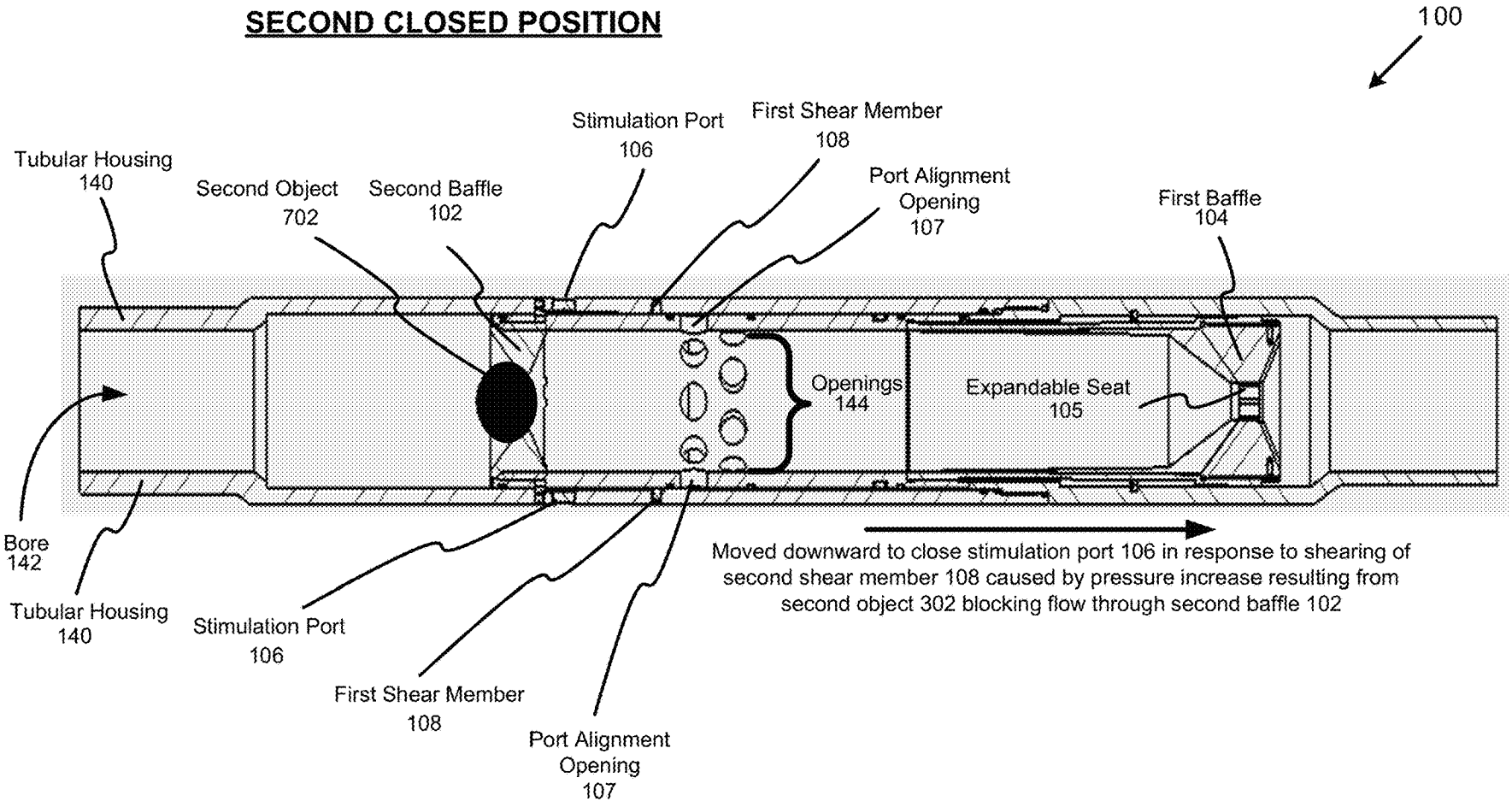
FIG. 8 is a cross-sectional view of the sleeve of FIG. 7 after the sleeve moves down to a second closed position in response to shearing of a second shear member due to a pressure increase, according to some embodiments.

FIG. 8 is a cross-sectional view of the sleeve of FIG. 7 after the sleeve moves down to a second closed position in response to shearing of second shear member due to a pressure increase, according to some embodiments. In FIG. 8, because the second object 702 is seated in the second baffle 102, flow of the stimulation fluid is blocked from flowing further downhole in the wellbore beyond the second baffle 102.

This will result in an increasing pressure on the second object 702. This pressure on the second object 702 continues to increase until the second shear member 110 is sheared forcing the sleeve 100 to move downward to a second closed position. In particular, as shown in FIG. 8, the sleeve 100 has moved downward such that the port alignment opening 107 is no longer aligned with the stimulation port 106. Accordingly, the stimulation fluid flowing in the bore 142 is no longer output through the stimulation port 106 via the openings 144 into the surrounding subsurface formation.

Figure 9:
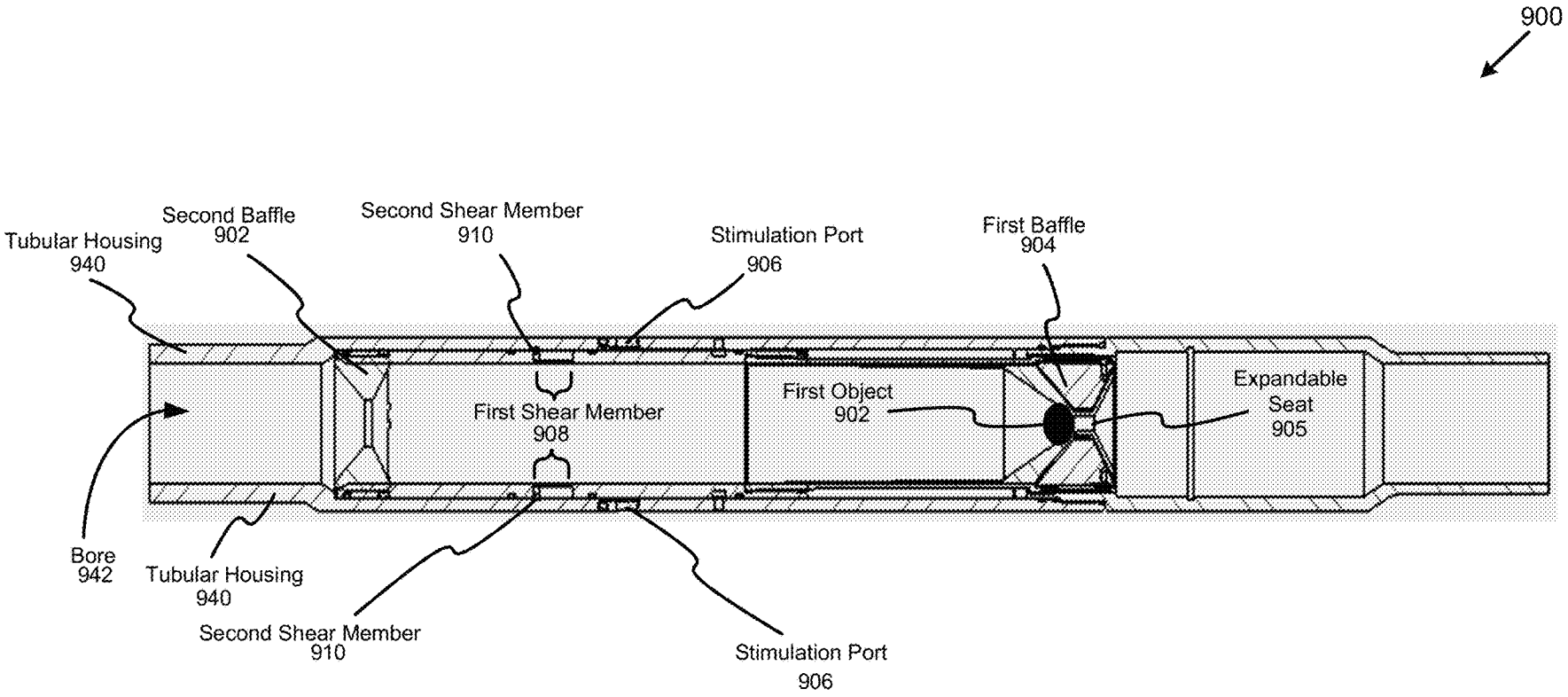
FIG. 9 is a cross-sectional view of a sleeve in a first closed position and to be positioned downhole in a wellbore, according to some other embodiments.

In some implementations, the sleeve may be configured to run as one sleeve downhole into positioned in the wellbore and then split in two after a first object is dropped. To illustrate, FIG. 9 is a cross-sectional view of a sleeve in a first closed position and to be positioned downhole in a wellbore, according to some other embodiments. FIG. 9 depicts a sleeve 900 that includes a similar configuration as the sleeve 100 of FIG. 1.

A sleeve 900 (shown in FIG. 9) is in a first closed position—which may be the position of the sleeve 900 while the sleeve 900 is run downhole into position in a casing lining a wellbore. An example of such a wellbore system is depicted in FIG. 12 (which is further described below).

In FIG. 9, assume a surface and bottom of the wellbore are on the left side and right side, respectively. The sleeve 900 may include a tubular housing 940 having a bore 942 formed therethrough. The sleeve 900 also includes a stimulation port 906.

The sleeve 900 also includes a first baffle 904 and a second baffle 902. The first baffle 904 includes an expandable seat 905. In this example, the second baffle 902 is positioned closer to a surface of the wellbore (as compared to the first baffle 904). In some implementations, the first baffle 904 may be a multi-entry (ME) baffle that includes an expandable seat. The second baffle 902 may be a single entry (SE) baffle that includes a solid (non-expandable) seat. The sleeve 900 also includes a first shear member 908 and a second shear member 910. The sleeve 900 may be held in position by the first shear member 908.

Similar to the sleeve 100, in some implementations, the sleeve 900 may include one or both of the dampening fluid and shock absorber to avoid the second shear member 910 being prematurely sheared and help the second shear member 910 to stop the sleeve 900 in the open position after the sleeve 900 moves downward after the first shear member 908 is sheared.

The sleeve 900 includes two shear members—a first shear member 908 and a second shear member 910. In some implementations, the first shear member 908 may be configured to be weaker than the second shear member 910.

After the first object is dropped, the first shear member 908 may be sheared—causing the sleeve 900 to be split in two parts. In response to the split, the bottom part of the sleeve 900 may move downward—exposing the stimulation port 906 to enable flow of a stimulation fluid out into the surrounding subsurface formation.

Similar to the configuration of the sleeve 100, the first object may continue downhole to close the sleeve below the sleeve 900. After stimulation operations are complete, a second object may be dropped down through the bore 942 and seated in the second baffle 902 to move the sleeve 900 to a closed position. Similar to the operations of the sleeve 100, the dropping of the second object may also open the sleeve above the sleeve 900.

Figure 10:
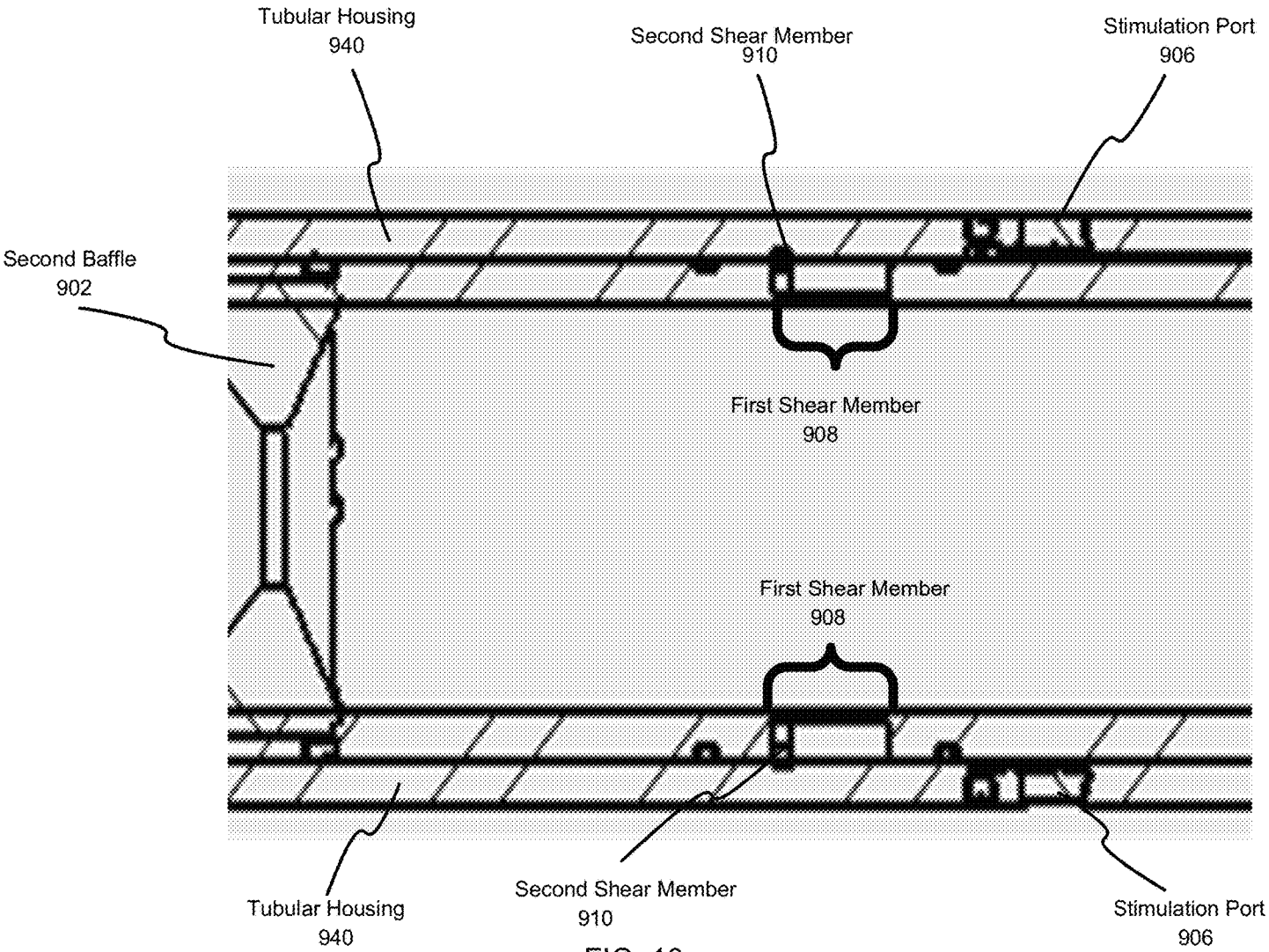
FIG. 10 is a more detailed cross-sectional view of a portion of the sleeve of FIG. 9, according to some embodiments.

FIG. 10 is a more detailed cross-sectional view of a portion of the sleeve of FIG. 9, according to some embodiments. FIG. 10 depicts a more detailed view of a portion of the tubular housing 940, the second baffle 902, the, the stimulation port 906, the first shear member 908, and the second shear member 910.

Example Operations

Figure 11:
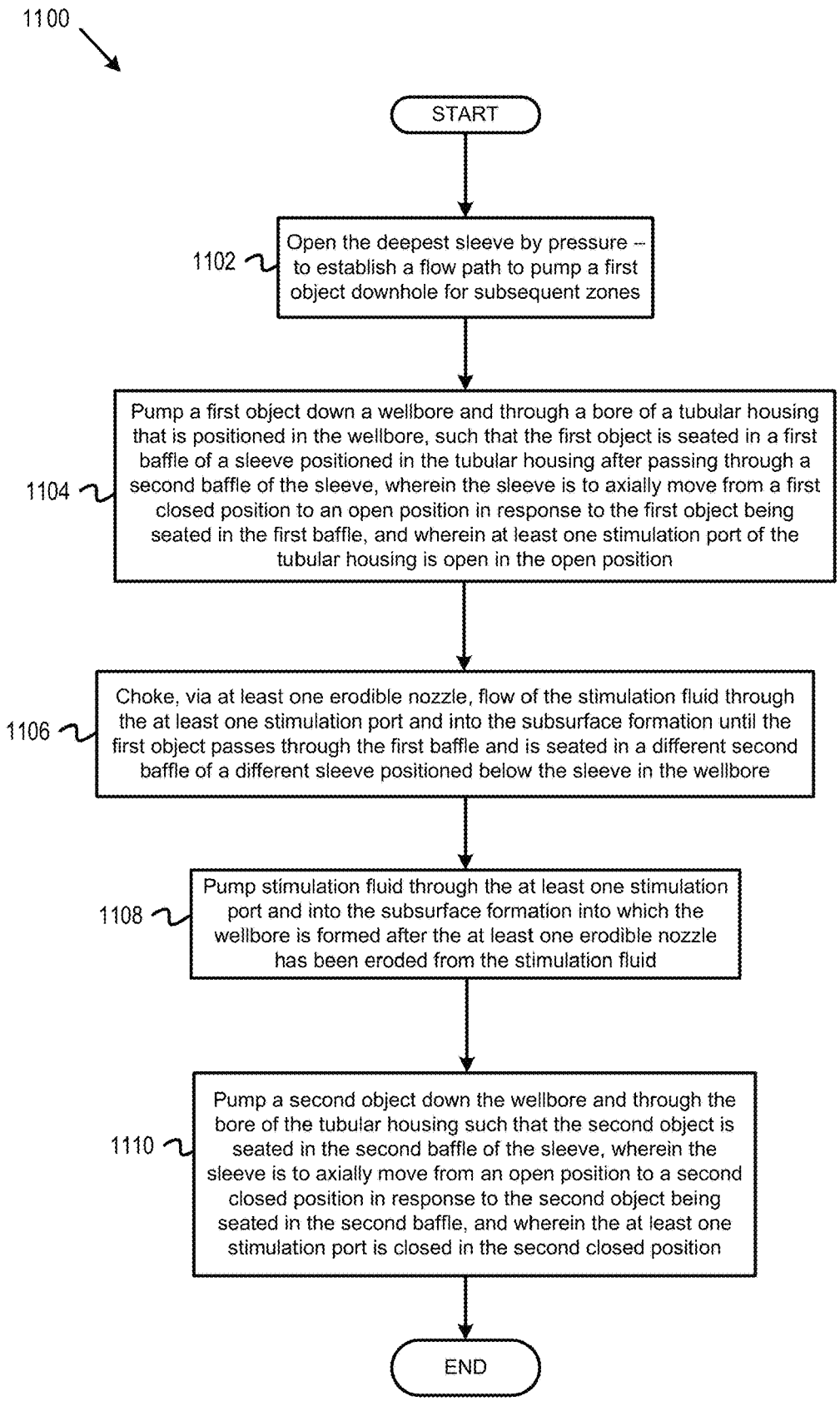
FIG. 11 is a flowchart of example operations of a sleeve having a multi-stage wellbore stimulation, according to some embodiments.

Example operations for using a sleeve for a multi-stage wellbore stimulation are now described. In particular, FIG. 11 is a flowchart of example operations of a sleeve having a multi-stage wellbore stimulation, according to some embodiments. Operations of a flowchart 11 of FIG. 11 can be performed by software, firmware, hardware, or a combination thereof. Operations of the flowchart 1100 are described in reference to the example of sleeves of FIGS. 1-8. However, other systems and components can be used to perform the operations now described. For example, operations of the flowchart 1100 may be performed by the example implementations depicted in FIGS. 9-10. The operations of the flowchart 1100 start at block 1102.

At block 1102, the sleeve that is deepest in the wellbore is opened by pressure from fluid flow down the wellbore—to establish a flow path to pump a first object downhole for subsequent zones. For example, a flow of fluid can be pumped downhole through the bores of the sleeves to open the sleeve that is deepest in the wellbore.

At block 1104, a first object is pumped down a wellbore and through a bore of a tubular housing that is positioned in the wellbore, such that the first object is seated in a first baffle of a sleeve positioned in the tubular housing after passing through a second baffle of the sleeve. The sleeve is to axially move from a first closed position to an open position in response to the first object being seated in the first baffle (wherein at least one stimulation port of the tubular housing is open in the open position). For example with reference to FIGS. 1-4, the first object 302 is pumped down the wellbore and through the bore 142 of the tubular housing 140. The first object 302 is seated in the expandable seat 105 of the first baffle 104 after passing through the second baffle 102. This results in the sleeve 100 moving from a first closed position to an open position—enabling the stimulation port 106 to be open.

At block 1106, at least one erodible nozzle in the at least one stimulation port chokes the flow of the stimulation fluid into the subsurface formation, until the first object passes through the first baffle and is seated in a different second baffle of a different sleeve positioned below the sleeve in the wellbore. For example with reference to FIGS. 1-4, the stimulation port 106 may include an erodible nozzle. The erodible nozzle may initially choke or block the flow through the stimulation port 106 in order to allow sufficient flow of the fluid downhole to ensure that the first object 302 lands in a different sleeve below this current sleeve in order to close this different sleeve. For example, the erodible nozzle may be composed of material that when exposed to the stimulation fluid breaks down or dissolves over time.

At block 1108, stimulation fluid is pumped through the at least one stimulation port and into the subsurface formation into which the wellbore is formed after the at least one erodible nozzle has been eroded from the stimulation fluid. For example with reference to FIGS. 1-4, after the erodible nozzle in the stimulation port 106 of the sleeve 100 erodes, stimulation (e.g., fracking) of the current subsurface formation may occur through the stimulation port 106 of the sleeve 100. This process may be repeated on multiple zones having sleeves with baffles with incrementally larger inner diameters and dropping incrementally larger objects.

At block 1110, a second object is pumped down the wellbore and through the bore of the tubular housing such that the second object is seated in the second baffle of the sleeve. The sleeve is to axially move from an open position to a second closed position in response to the second object being seated in the second baffle (wherein the at least one stimulation port is closed in the second closed position). For example with reference to FIGS. 7-8, the second object 708 is pumped down the wellbore and through the bore 142 of the tubular housing 140 such that the second object 708 is seated in the second baffle 102. This results in the sleeve moving from the open position to the second closed position.

Example System

An example system having sleeves for a multi-stage wellbore stimulation is now described. In particular, FIG. 12 is an elevation view in partial cross section of a well system having sleeves for multi-stage stimulation, according to some embodiments.

FIG. 12 includes a multi-zone fracturing system (hereinafter "system) 1210. As illustrated, the system 1210 may be disposed in a wellbore 1212 lined with a casing 1214 and a cement 1216. The system 1210 may include multiple sleeves 1218 positioned in the wellbore 1212 and installed along the casing 1214. The sleeves 1218 may be run in on a production string 1219. As used herein, the term "casing" is intended to be understood broadly as referring to casing and/or liners. The sleeves 1218 may be positioned at predetermined locations along the length of the wellbore 1212. These locations may correspond to the formation of perforations 1220 through the casing 1214 and cement 1216, and outward into a subsurface formation 1222 surrounding the wellbore 1212. Examples of the sleeves 1218 are depicted in FIGS. 1-10 (described above). As described above, the sleeves 1218 may be selectively opened to provide access from an interior of the wellbore 1212 surrounded by the casing 1214 to the formation 1222.

As illustrated, any number of sleeves 1218 may be positioned along the length of the wellbore 1212 in order to accommodate selective exposure of different zones 1224 of the formation 1222 to the wellbore 1212. This may be particularly desirable when perforating the different zones 1224 of the formation 1222 or providing fracture treatments to previously formed perforations 1220 or in open hole sections (no casing) at the different zones 1224. The different zones 1224 may be isolated using packers 1290.

While FIG. 12 depicts the system 1210 as being arranged along a vertically oriented portion of the wellbore 1212, it will be appreciated that the system 1210 may be equally arranged in a horizontal or slanted portion of the wellbore 1212, or any other angular configuration therebetween. Additionally, the system 1210 may be arranged along other portions of the vertical wellbore 1212 in order to provide access to the formation 1222 at a location closer to a toe portion 1226 of the wellbore 1212.

While the aspects of the disclosure are described with reference to various implementations and exploitations, it will be understood that these aspects are illustrative and that the scope of the claims is not limited to them. In general, techniques for simulating drill bit abrasive wear and damage during the drilling of a wellbore as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

Example Embodiments

Embodiment #1: An assembly for incorporation into a completion string and to be positioned in a wellbore, the assembly comprising: a tubular housing having a bore therethrough and at least one stimulation port therein to communicate fluid from the bore to outside the tubular housing; and a sleeve axially movable in the tubular housing, the sleeve comprising, a first baffle; and a second baffle, wherein the sleeve is initially in a first closed position, wherein the sleeve is to axially move from the first closed position to an open position in response to the first baffle receiving a first object therein, wherein the at least one stimulation port is open in the open position, and wherein the sleeve is to axially move from the open position to a second closed position in response to the second baffle receiving a second object received therein, wherein the second object is larger than the first object, where the at least one stimulation port is closed in the second closed position.

Embodiment #2: The assembly of Embodiment #1, wherein the at least one stimulation port comprises at least one erodible nozzle.

Embodiment #3: The assembly of any one Embodiments #1-2, wherein after the at least one stimulation port is opened, the at least one erodible nozzle is to choke flow of a fluid through the at least one stimulation port for a defined time period.

Embodiment #4: The assembly of Embodiment #3, wherein the defined time period is at least a period of time until the first object passes through the first baffle and is seated in a different second baffle of a different sleeve positioned below the sleeve in the wellbore.

Embodiment #5: The assembly of any one Embodiments #1-4, wherein the sleeve comprises: at least one first shear member that is to be sheared in response to a pressure increase from the first object being seated in the first baffle; and at least one second shear member that is to be sheared in response to a pressure increase from the second object being seated in the second baffle.

Embodiment #6: The assembly of Embodiment #5, wherein the sleeve is to split into two portions in response to the at least one first shear member being sheared.

Embodiment #7: The assembly of Embodiment #5, further comprising at least one of a dampening fluid or a shock absorber positioned to reduce impact from the axial movement of the sleeve on the at least one second shear member after the at least one first shear member is sheared.

Embodiment #8: The assembly of any one Embodiments #1-7, wherein the first baffle comprises a multi-entry baffle with an expandable seat and the second baffle comprises a single entry baffle with a non-expandable seat.

Embodiment #9: The assembly of any one Embodiments #1-8, wherein the first object is to pass through the first baffle and into a different sleeve below the sleeve to close the different sleeve.

Embodiment #10: A multi-stage completion system for a wellbore, the multi-stage completion system comprising: a completion string having a number of assemblies and to be positioned in the wellbore, wherein each assembly of the number of assemblies comprises, a tubular housing having a bore therethrough and at least one stimulation port therein to communicate fluid from the bore to outside the tubular housing; and a sleeve axially movable in the tubular housing, the sleeve comprising, a first baffle; and a second baffle, wherein the sleeve is initially in a first closed position, wherein the sleeve is to axially move from the first closed position to an open position in response to the first baffle receiving a first object therein, wherein the at least one stimulation port is open in the open position, and wherein the sleeve is to axially move from the open position to a second closed position in response to the second baffle receiving a second object received therein, wherein the second object is larger than the first object, where the at least one stimulation port is closed in the second closed position.

Embodiment #11: The multi-stage completion system of Embodiment #10, wherein the at least one stimulation port comprises at least one erodible nozzle, wherein after the at least one stimulation port is opened, the at least one erodible nozzle is to choke flow of a fluid through the at least one stimulation port for a defined time period, wherein the defined time period is at least a period of time until the first object passes through the first baffle and is seated in a different second baffle of a different sleeve positioned below the sleeve in the wellbore.

Embodiment #12: The multi-stage completion system of any one Embodiments #10-11, wherein the sleeve comprises: at least one first shear member that is to be sheared in response to a pressure increase from the first object being seated in the first baffle; and at least one second shear member that is to be sheared in response to a pressure increase from the second object being seated in the second baffle.

Embodiment #13: The multi-stage completion system of Embodiment #12, wherein the sleeve is to split into two portions in response to the at least one first shear member being sheared.

Embodiment #14: The multi-stage completion system of Embodiment #12, further comprising at least one of a dampening fluid or a shock absorber positioned to reduce impact from the axial movement of the sleeve on the at least one second shear member after the at least one first shear member is sheared.

Embodiment #15: The multi-stage completion system of any one Embodiments #10-14, wherein the first baffle comprises a multi-entry baffle with an expandable seat and the second baffle comprises a single entry baffle with a non-expandable seat.

Embodiment #16: The multi-stage completion system of any one Embodiments #10-15, wherein the first object is to pass through the first baffle and into a different sleeve below the sleeve to close the different sleeve.

Embodiment #17: A method for stimulating a subsurface formation into which a wellbore is formed, the method comprising: pumping a first object down the wellbore and through a bore of a tubular housing that is positioned in the wellbore, such that the first object is seated in a first baffle of a sleeve positioned in the tubular housing after passing through a second baffle of the sleeve, wherein the sleeve is to axially move from a first closed position to an open position in response to the first object being seated in the first baffle, and wherein at least one stimulation port of the tubular housing is open in the open position; pumping stimulation fluid through the at least one stimulation port and into the subsurface formation; and pumping a second object down the wellbore and through the bore of the tubular housing such that the second object is seated in the second baffle of the sleeve, wherein the sleeve is to axially move from an open position to a second closed position in response to the second object being seated in the second baffle, and wherein the at least one stimulation port is closed in the second closed position.

Embodiment #18: The method of Embodiment #17, further comprising: choking, via at least one erodible nozzle, flow of the stimulation fluid through the at least one stimulation port and into the subsurface formation until the first object passes through the first baffle and is seated in a different second baffle of a different sleeve positioned below the sleeve in the wellbore.

Embodiment #19: The method of any one Embodiments #17-18, further comprising: flowing the stimulation fluid through the at least one stimulation port and into the subsurface formation after the at least one erodible nozzle has eroded from the stimulation fluid.

Embodiment #20: The method of any one Embodiments #17-19, wherein the sleeve comprises: at least one first shear member that is to be sheared in response to a pressure increase from the first object being seated in the first baffle; and at least one second shear member that is to be sheared in response to a pressure increase from the second object being seated in the second baffle.

Embodiment #21: The method of Embodiment #20, wherein the sleeve is to split into two portions in response to the at least one first shear member being sheared.

Embodiment #22: The method of Embodiment #20, further comprising: reducing, by at least one of a dampening fluid or a shock absorber, impact from the axial movement of the sleeve on the at least one second shear member after the at least one first shear member is sheared.

Embodiment #23: The method of any one Embodiments #17-22, wherein the first baffle comprises a multi-entry baffle with an expandable seat and the second baffle comprises a single entry baffle with a non-expandable seat.

Embodiment #24: The method of any one Embodiments #17-23, wherein the first object is to pass through the first baffle and into a different sleeve below the sleeve to close the different sleeve.

The invention claimed is:

1. An assembly for incorporation into a completion string and to be positioned in a wellbore, the assembly comprising:

a tubular housing having a bore therethrough and at least one stimulation port therein to communicate fluid from the bore to outside the tubular housing; and a single sleeve comprising a first baffle configured to receive a first object and a second baffle configured to receive a second object, the single sleeve configured to be axially movable in the tubular housing to position both the first baffle and the second baffle to at least three different positions relative to the tubular housing, wherein the single sleeve is initially in a first closed position, wherein the single sleeve is configured to axially move from the first closed position to an open position in response to the first baffle receiving the first object therein, wherein the at least one stimulation port is open in the open position, and wherein the single sleeve is configured to axially move from the open position to a second closed position in response to the second baffle receiving the second object received therein, wherein the second object is larger than the first object, and wherein the at least one stimulation port is closed in the second closed position.

2. The assembly of claim 1, wherein the at least one stimulation port comprises at least one erodible nozzle.

3. The assembly of claim 2, wherein after the at least one stimulation port is opened, the at least one erodible nozzle is to choke flow of a fluid through the at least one stimulation port for a defined time period.

4. The assembly of claim 3, wherein the defined time period is at least a period of time until the first object passes through the first baffle and is seated in a different second baffle of a different sleeve positioned below the single sleeve in the wellbore.

5. The assembly of claim 1, wherein the single sleeve comprises:

at least one first shear member that is to be sheared in response to a pressure increase from the first object being seated in the first baffle; and at least one second shear member that is to be sheared in response to a pressure increase from the second object being seated in the second baffle.

6. The assembly of claim 5, further comprising at least one of a dampening fluid or a shock absorber positioned to reduce impact from the axial movement of the single sleeve on the at least one second shear member after the at least one first shear member is sheared.

7. The assembly of claim 1, wherein the first baffle comprises a multi-entry baffle with an expandable seat and the second baffle comprises a single entry baffle with a non-expandable seat.

8. The assembly of claim 1, wherein the first object is to pass through the first baffle and into a different sleeve below the single sleeve to close the different sleeve.

9. The assembly of claim 5, wherein the at least one second shear member is configured to stop the axial movement of the single sleeve at the open position so that at least one port alignment opening aligns with the at least one stimulation port.

10. A multi-stage completion system for a wellbore, the multi-stage completion system comprising:

a completion string having a plurality of assemblies and configured to be positioned in the wellbore, wherein each assembly of the plurality of assemblies comprises, a tubular housing having a bore therethrough and at least one stimulation port therein to communicate fluid from the bore to outside the tubular housing; and a single sleeve comprising a first baffle configured to receive a first object and a second baffle configured to receive a second object, the single sleeve configured to be axially movable in the tubular housing to position both the first baffle and the second baffle to at least three different positions relative to the tubular housing, wherein the single sleeve is initially in a first closed position, wherein the single sleeve is configured to axially move from the first closed position to an open position in response to the first baffle receiving the first object therein, wherein the at least one stimulation port is open in the open position, and wherein the single sleeve is configured to axially move from the open position to a second closed position in response to the second baffle receiving the second object received therein, wherein the second object is larger than the first object, and wherein the at least one stimulation port is closed in the second closed position.

11. The multi-stage completion system of claim 10, wherein the at least one stimulation port comprises at least one erodible nozzle, wherein after the at least one stimulation port is opened, the at least one erodible nozzle is to choke flow of a fluid through the at least one stimulation port for a defined time period, wherein the defined time period is at least a period of time until the first object passes through the first baffle and is seated in a different second baffle of a different sleeve positioned below the single sleeve in the wellbore.

12. The multi-stage completion system of claim 10, wherein the single sleeve comprises:

at least one first shear member that is to be sheared in response to a pressure increase from the first object being seated in the first baffle; and at least one second shear member that is to be sheared in response to a pressure increase from the second object being seated in the second baffle.

13. The multi-stage completion system of claim 12, further comprising at least one of a dampening fluid or a shock absorber positioned to reduce impact from the axial movement of the single sleeve on the at least one second shear member after the at least one first shear member is sheared.

14. The multi-stage completion system of claim 10, wherein the first baffle comprises a multi-entry baffle with an expandable seat and the second baffle comprises a single entry baffle with a non-expandable seat.

15. The multi-stage completion system of claim 10, wherein the first object is to pass through the first baffle and into a different sleeve below the single sleeve to close the different sleeve.

16. The multi-stage completion system of claim 12, wherein the at least one second shear member is configured to stop the axial movement of the single sleeve at the open position so that at least one port alignment opening aligns with the at least one stimulation port.

17. A method for stimulating a subsurface formation into which a wellbore is formed, the method comprising:

pumping a first object down the wellbore and through a bore of a tubular housing that is positioned in the wellbore, such that the first object is seated in a first baffle of a single sleeve positioned in the tubular housing after passing through a second baffle of the single sleeve, wherein the single sleeve is to axially move from a first closed position to an open position in response to the first object being seated in the first baffle, and wherein at least one stimulation port of the tubular housing is open in the open position;

pumping stimulation fluid through the at least one stimulation port and into the subsurface formation; and pumping a second object down the wellbore and through the bore of the tubular housing such that the second object is seated in the second baffle of the single sleeve, wherein the single sleeve is to axially move from an open position to a second closed position in response to the second object being seated in the second baffle, and wherein the at least one stimulation port is closed in the second closed position.

18. The method of claim 17, further comprising:

choking, via at least one erodible nozzle, flow of the stimulation fluid through the at least one stimulation port and into the subsurface formation until the first object passes through the first baffle and is seated in a different second baffle of a different sleeve positioned below the single sleeve in the wellbore.

19. The method of claim 18, further comprising:

flowing the stimulation fluid through the at least one stimulation port and into the subsurface formation after the at least one erodible nozzle has eroded from the stimulation fluid.

20. The method of claim 17, wherein the single sleeve comprises:

at least one first shear member that is to be sheared in response to a pressure increase from the first object being seated in the first baffle; and at least one second shear member that is to be sheared in response to a pressure increase from the second object being seated in the second baffle.

21. The method of claim 20, further comprising:

reducing, by at least one of a dampening fluid or a shock absorber, impact from the axial movement of the single sleeve on the at least one second shear member after the at least one first shear member is sheared.

22. The method of claim 17, wherein the first baffle comprises a multi-entry baffle with an expandable seat and the second baffle comprises a single entry baffle with a non-expandable seat.

23. The method of claim 17, wherein the first object is to pass through the first baffle and into a different sleeve below the single sleeve to close the different sleeve.

24. The method of claim 20, wherein the at least one second shear member stops the axial movement of the single sleeve at the open position so that at least one port alignment opening aligns with the at least one stimulation port.

* * * * *